US005390501A

United States Patent [19]

Davis et al.

[11] Patent Number: 5,390,501

[45] Date of Patent: Feb. 21, 1995

[54] HYDRAULIC CONVEYANCE OF PARTICULATE MATERIALS SUCH AS ICE PARTICLES

[75] Inventors: Thomas L. Davis, Raleigh; Alexander O. Hobbs, Cary; Joseph A. Gregory, Angier; Barney P. Roberts, Jr., Wake Forest, all of N.C.

[73] Assignee: Carolina Power & Light Company, Raleigh, N.C.

[21] Appl. No.: 180,924

[22] Filed: Jan. 12, 1994

[51] Int. Cl.[6] ..... F25C 5/18

[52] U.S. Cl. ..... 62/59; 62/344; 406/108

[58] Field of Search ..... 62/59, 344; 406/108-112, 124

[56] References Cited

U.S. PATENT DOCUMENTS

| | | | |
|---|---|---|---|
| 1,478,678 | 12/1923 | Schiesari | 406/117 |
| 2,252,501 | 8/1941 | Foresman | 406/120 |
| 2,811,393 | 10/1957 | Little | 406/117 |
| 2,818,305 | 12/1957 | Pursel | 406/120 |
| 3,306,671 | 2/1967 | Leeman | 406/123 |
| 3,367,495 | 2/1968 | Lea | 209/163 |
| 3,877,241 | 4/1975 | Wade | 406/3 |
| 4,104,889 | 8/1978 | Hoenisch | 406/156 |
| 4,940,535 | 7/1990 | Fisher | 406/155 |
| 5,195,850 | 3/1993 | Davis | 406/92 |

*Primary Examiner*—William E. Tapolcai

*Attorney, Agent, or Firm*—Richard S. Faust

[57] ABSTRACT

A hydraulic conveyance system serves to level out a spiked, uneven flow of particulate material to a more even flow condition prior to the particles being delivered to a destination. In one particular application, the hydraulic conveyance system permits ice particles to be delivered from a batch discharge ice machine of a thermal energy production, storage and reclaim system to the thermal energy storage tank of the system at a relatively even rate, without the use of any mechanical delivery mechanisms. The hydraulic conveyance system incorporates a flooded hold-up tank which, in the case of particulate ice conveyance, receives the spiked, batch discharge from the ice machine and discharges the ice therefrom to a selected number of destination points at a more even flow condition. A rotational movement is imparted to the water surface in the flooded hold-up tank, thereby causing the floating ice particles to rotate in the tank in proximity to a boundary wall of the tank. Weirs located in the boundary wall permit the ice and a portion of the water in the tank to overflow therethrough. The ice/water mixture from each weir is conveyed by a delivery system to a respective destination point in the thermal energy storage tank. Intermediate ice/water separation tanks may be inserted between each weir and the thermal energy storage tank to further enhance system operation.

21 Claims, 8 Drawing Sheets

HYDRAULIC CONVEYANCE OF PARTICULATE MATERIALS SUCH AS ICE PARTICLES

FIELD OF THE INVENTION

The invention relates generally to the conveyance of particulate material. More particularly, in certain preferred embodiments, the invention relates to the hydraulic conveyance of ice particles in an ice-in-water regime from a first point to a destination while leveling out the flow rate of the particles during transport.

BACKGROUND OF THE INVENTION

The transport of particulate material sometimes requires that a relatively spiked, uneven flow of particles be leveled out to a more even flow condition prior to the particles being delivered to a destination. An example of this situation occurs in connection with recently developed thermal energy production, storage and reclaim systems where an ice machine is utilized to produce ice particles that are conveyed to a thermal energy storage tank that stores the ice. In these systems the ice particles discharged from the ice machine are entrained in a transport water and transported to the thermal energy storage tank. A primary purpose of this thermal energy production, storage and reclaim technology, as discussed in detail in commonly assigned U.S. Pat. Nos. 5,046,551; 5,063,748; and 5,195,850, incorporated herein by reference, is to permit a low power prime mover in the form of an ice machine to be used continuously to produce ice, to store the energy in the form of ice and thereafter withdraw the energy in large quantities when needed. With such a system in place at an installation with high peak time power requirements, the power company has the advantage of providing power continuously to a relatively low power, level load instead of having to meet very high energy demands at peak load periods. More particularly, the above-mentioned commonly assigned patents describe a thermal energy production, storage and reclaim system wherein ice is produced primarily at off-peak times by a vapor compression ice making machine and delivered entrained in a transport water by a sluice conduit to a relatively large thermal energy storage tank. In particular embodiments, the ice is delivered to a point near the bottom of the thermal energy storage tank through a hopper and downpipe arrangement that overcomes the problems associated with delivering a buoyant particle to the bottom of a flooded vessel. The ice particles so introduced into the storage tank agglomerate into a submerged ice mass that generally takes the shape of an inverted cone.

In addition to the above-mentioned problems associated with the transport of buoyant particles such as ice particles, an additional problem has emerged with respect to the use of conventional ice machines. It is well known that many ice machines, rather than delivering ice on a continuous discharge basis, discharge ice in large "slugs" over relatively short spans of time so that there are considerable periods of time during which no ice or little ice is being discharged by the ice machine. This batch ice delivery is a type of spiked, uneven flow condition and presents a problem with respect to matching the ice machine discharge rate with the flow rates that can be accepted by the sluicing system hoppers and downpipes. Stated differently, if the large slugs of ice were to be directly introduced into the sluicing system and thermal energy storage tank without reducing the spikes in the flow rate, the ice slugs would overwhelm the capacity of these delivery systems. Thus, there is a need for a system to level out the spiked, uneven flow rate created by the ice machine to a more even flow condition consistent with the capabilities of the sluicing lines and downpipe delivery system to the thermal energy storage tank.

One proposed solution to the above problem is to use mechanical augers to deliver the ice to the thermal energy storage tank. However, the augers are mechanical systems subject to breakdown. Furthermore, the motors of augers use substantially more energy than the pumps of a comparably sized hydraulic conveyance system. In addition to these disadvantages, and more important, an ice-in-water, two-phase flow regime in the augers can easily result in a bridging of the two-phase system into an almost solid ice mass which would prevent the auger from moving ice. Stated differently, the ice and water mixture in the auger, under certain conditions, can freeze into a solid mass, thereby "clogging" the auger and rendering it useless.

SUMMARY OF THE INVENTION

The present invention provides a novel and versatile apparatus and method for leveling out the flow ram of particulate material being transported from one location to another, while also providing the capability of distributing the particulate material to multiple destinations, when desired. The invention is carried out utilizing hydraulic conveyance principles, without any need for mechanical delivery systems. The invention finds its primary utility in situations where a spiked, uneven flow of particulate material must be converted to a more even flow condition.

In one aspect, the present invention may bé carried out by first delivering a spiked, uneven flow of particulate material to a hold-up tank which has a central axis and defines a vertical, circular boundary wall structure about the axis. The hold-up tank contains a liquid that is more dense than the particulate material so that the particulate material floats in the hold-up tank. A rotational surface movement is imparted to the liquid in the hold-up tank sufficient to carry the particulate material floating in the tank in a rotary motion about the central axis of the tank and in proximity to the vertical, circular boundary wall structure. The particulate material and a portion of the liquid in the hold-up tank are overflowed through at least one weir located in the boundary wall structure at the water surface level. The overflow is at a particulate material flow rate that is leveled out to a more even rate than its spiked, uneven rate of introduction into the hold-up tank.

The hold-up tank may take the form of an upright cylindrical tank with the weirs located in the outer circular walls of the tank. In this instance, the centrifugal forces in the tank must be overcome by means which will push the particulate material toward the outer walls of the holdup tank so that the particles rotate in proximity to the outer wall where the weirs are located.

In other embodiments, the hold-up tank may take the form of a ring-like structure having an outer containment wall and an inner, vertical, circular boundary wall structure which together define a ring-like tank with the ice and a portion of the water in the tank being overflowed through at least one weir in the inner wall.

In one particular application of the invention, the novel hydraulic conveyance system permits ice particles to be delivered from a batch discharge ice machine of a thermal energy production, storage and reclaim system to the thermal energy storage tank of the system at a relatively even rate, without the use of any mechanical delivery devices. In certain embodiments designed according to this aspect of the invention, the leveling out of the ice particle flow rate permits the buoyant ice particles to be injected to a submerged location in a flooded thermal energy storage tank without overwhelming the injection system. The hold-up tank is located in the transport system that transports the ice particles entrained in water from the ice machine to the thermal energy storage tank.

BRIEF DESCRIPTION OF THE DRAWINGS

Some of the objects having been stated, other objects will appear as the description proceeds, when taken in connection with the accompanying drawings, in which.

DETAILED DESCRIPTION OF THE INVENTION

While the present invention will be described more fully hereinafter with reference to the accompanying drawings, in which aspects of the preferred manner of practicing the present invention are shown, it is to be understood at the outset of the description which follows that persons of skill in the appropriate arts may modify the invention herein described while still achieving the favorable results of this invention. Accordingly, the description which follows is to be understood as being a broad, teaching disclosure directed to persons of skill in the appropriate arts, and not as limiting upon the present invention.

Figure 1:
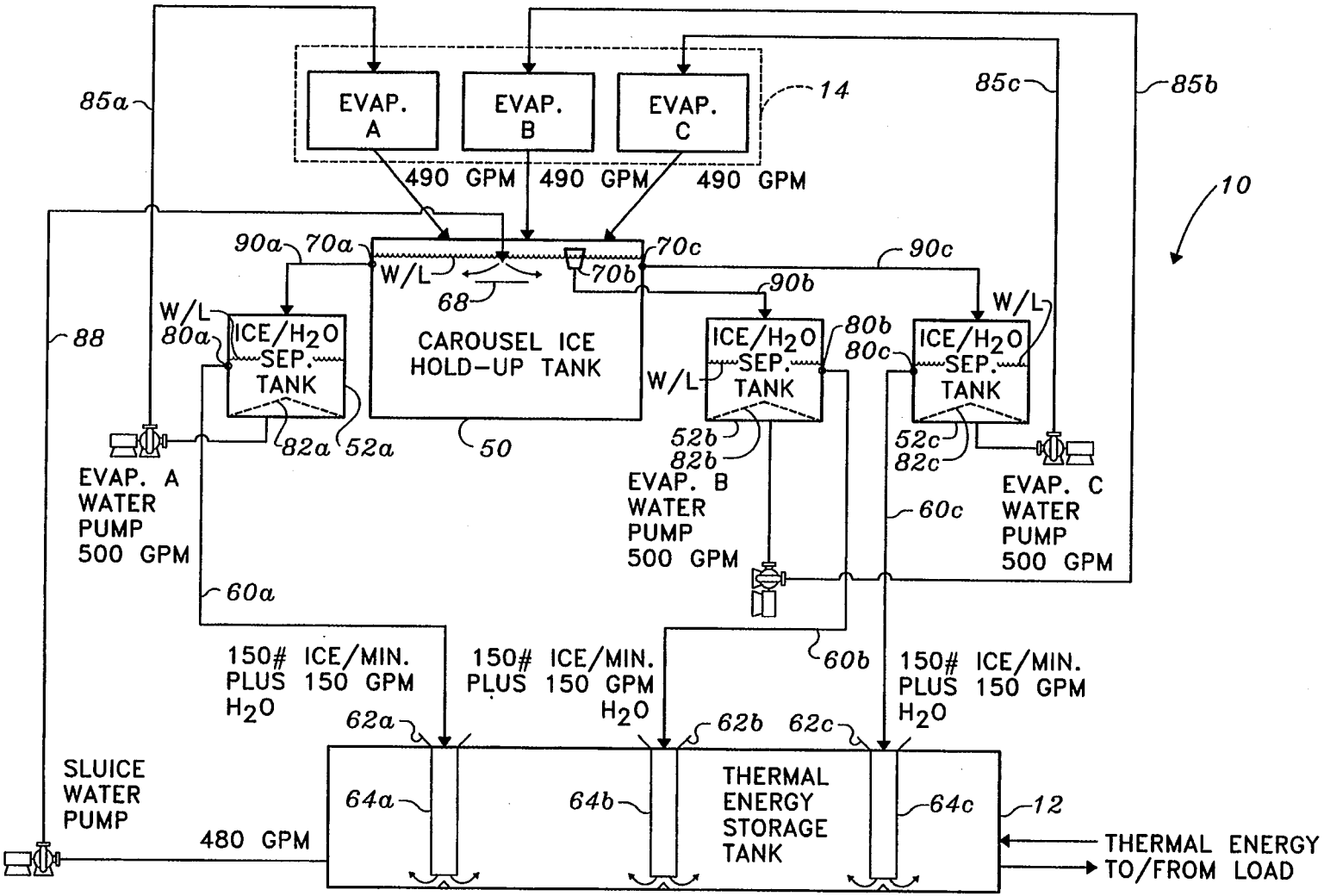
FIG. 1 is a schematic representation of an ice harvesting thermal energy production, storage and reclaim system utilizing the principles of the present invention.

Referring to the drawings, FIG. 1 is a schematic representation of a thermal energy production, storage and reclaim system 10 incorporating the principles of the present invention. The purpose of the system is to produce ice at ice machine 14 and deliver the ice to the thermal energy storage tank 12 so that the stored energy may be used to meet loads that are uncoupled from the power supply.

Figure 5:
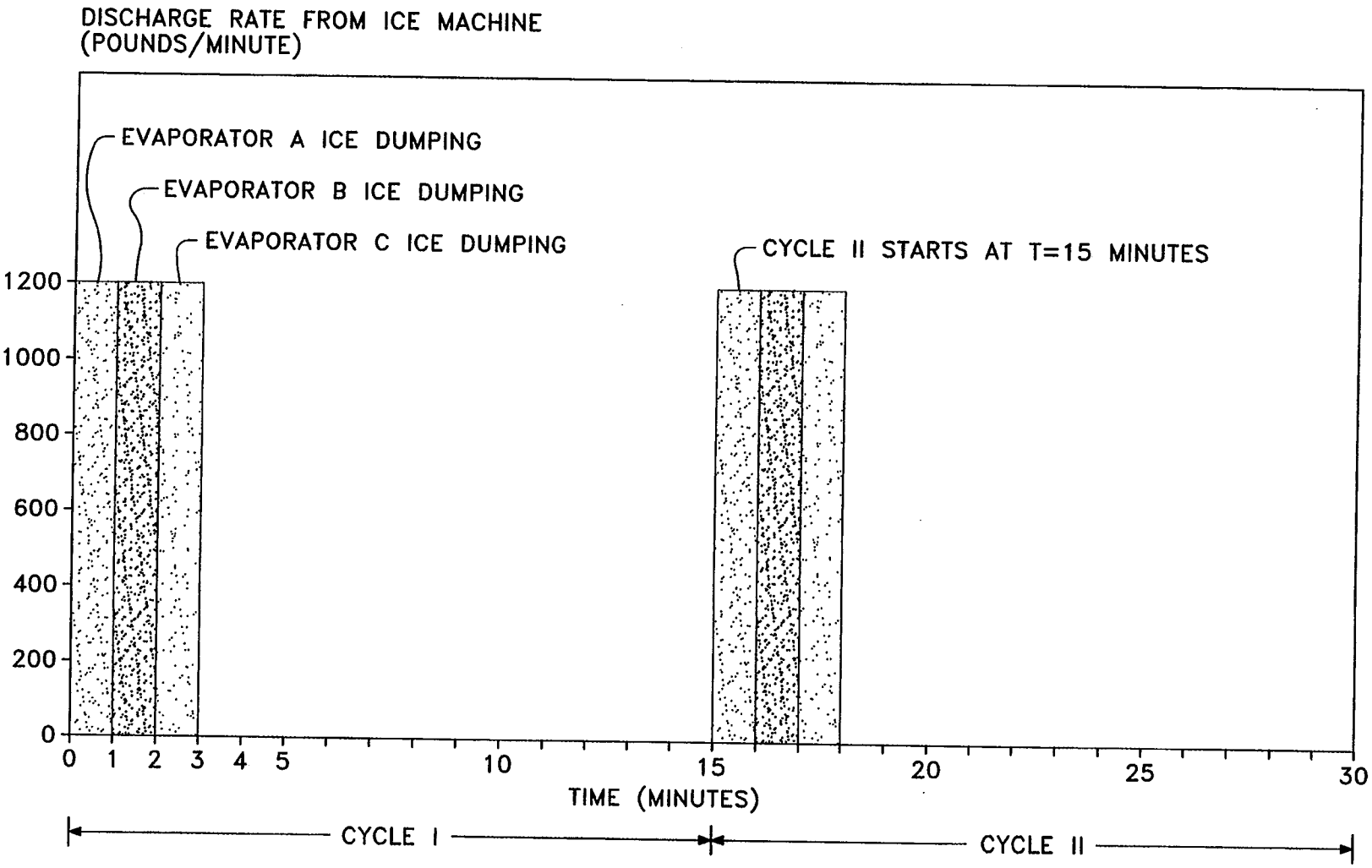
FIG. 5 is a graph showing two representative fifteen minute cycles for the ice machine, with ice from the three evaporators A, B, C being dumped in respective one minute time spans, followed by a twelve minute span in which no ice is dumped.

Ice machine 14 is a vapor compression, batch discharge, dynamic harvesting type of machine that includes three evaporators A, B, C. In one embodiment, the ice machine takes the form of a Model No. CIM-PA-250HVS-185WC ice machine manufactured by Morris & Associates of Garner, N.C., U.S.A. Each evaporator produces one-third of the total ice output of ice machine 14. As shown in FIG. 5, the machine does not dump the ice from the evaporators on a continuous basis; instead, the ice is dumped on a batch basis in three "slugs." Evaporator A dumps ice for one minute followed by evaporator B dumping ice for one minute, followed by evaporator C dumping ice for one minute, followed by a twelve minute period of no dumping while ice is being formed in or on the evaporators. Since each evaporator dumps approximately 1200 pounds of ice in its one minute dump, a total of approximately 3600 pounds of ice are dumped in a three minute span, followed by twelve minutes of no dumping. Thus, the average ice discharge rate over fifteen minutes is approximately 240 pounds per minute which translates into 360,000 pounds per day (180 tons per day).

If the three slugs of ice discharged over the three minute span were directly introduced into the ice delivery system (the sluice pipes 60*a*, 60*b*, 60*c*; hoppers 62*a*, 62*b*, 62*c*; downpipes 64*a*, 64*b*, 64*c* described in the above-mentioned commonly assigned U.S. Pat. Nos. 5,046,551; 5,063,748; and 5,195,850), the ice delivery system would be overwhelmed; i.e., it could not handle the 1200 pounds per minute ice dumping rate over the first three minutes of the fifteen minute cycle. However, the ice delivery system is capable of handling the average ice production rate over the entire fifteen minute cycle (i.e., 240 pounds per minute), as well as rates substantially in excess of that average. Thus, there is a need to even out the rate at which ice is introduced into the ice delivery system. It should be noted that part of the capacity problem in the ice delivery system is in the sluice line(s), but even if that problem is solved by more or larger sluice lines, the hoppers overlying the thermal energy storage tank and the associated downpipes into the tank (which are utilized to inject the buoyant ice particles to submerged location(s) in the tank) still could not handle ice introduction at 1200 pounds per minute, while they can easily handle rates on the order of 240 pounds per minute.

Referring back to FIG. 1, the solution offered by the present invention is to allow each evaporator A, B, C to dump its ice into a twelve foot diameter, 2500 gallon cylindrical carousel ice hold-up tank 50 which, in turn, delivers the ice in roughly equal amounts to each of three ice/water separation tanks 52*a*, 52*b*, 52*c* which, in their turn, deliver ice to the thermal energy storage tank 12 by means of sluice lines 60*a*, 60*b*, 60*c*, respectively. By means described below, the above system, with appropriate pumping and flow rates, serves to even out the flow rate of ice to a more even flow rate so that the sluice lines 60*a*, 60*b*, 60*c* and their respective hoppers 62*a*, 62*b*, 62*c* and downpipes 64*a*, 64*b*, 64*c* associated with thermal energy storage tank 12 are not overloaded. It will be appreciated that the ice particles always are entrained in water in a two-phase situation from the time they are discharged from the ice machine until they are delivered to the storage tank.

Figure 2:
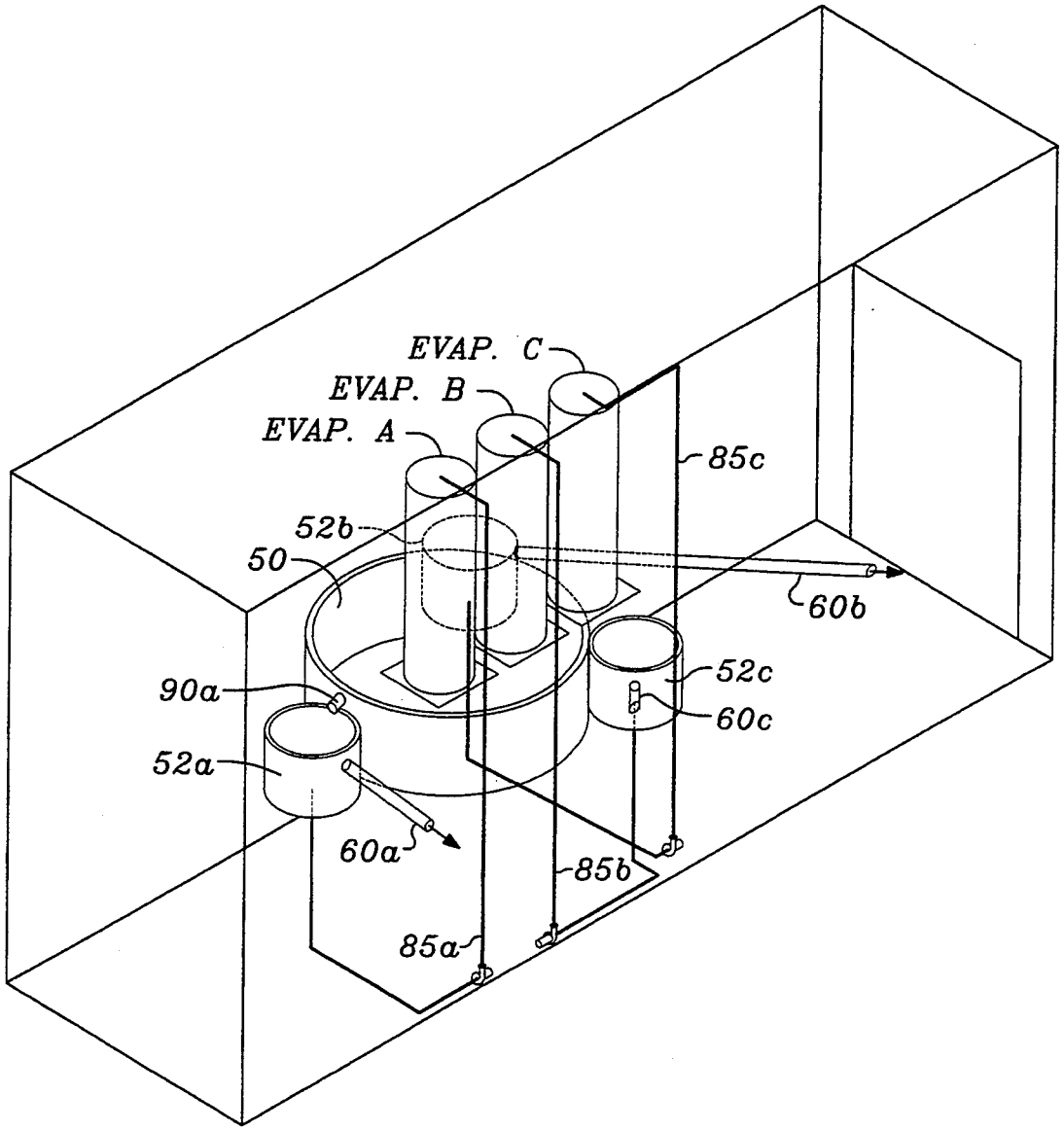
FIG. 2 is a pictorial representation of the ice machine, hold-up tank, ice/water separation tanks and several of the conduits that are incorporated into the system illustrated in FIG. 1.
Figure 3:
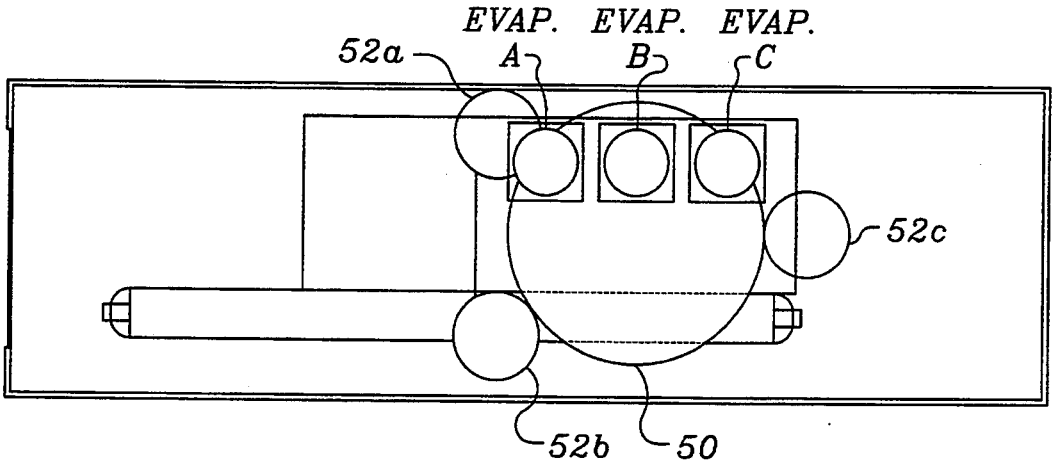
FIG. 3 is a top view of the structure illustrated in FIG. 2.
Figure 4:
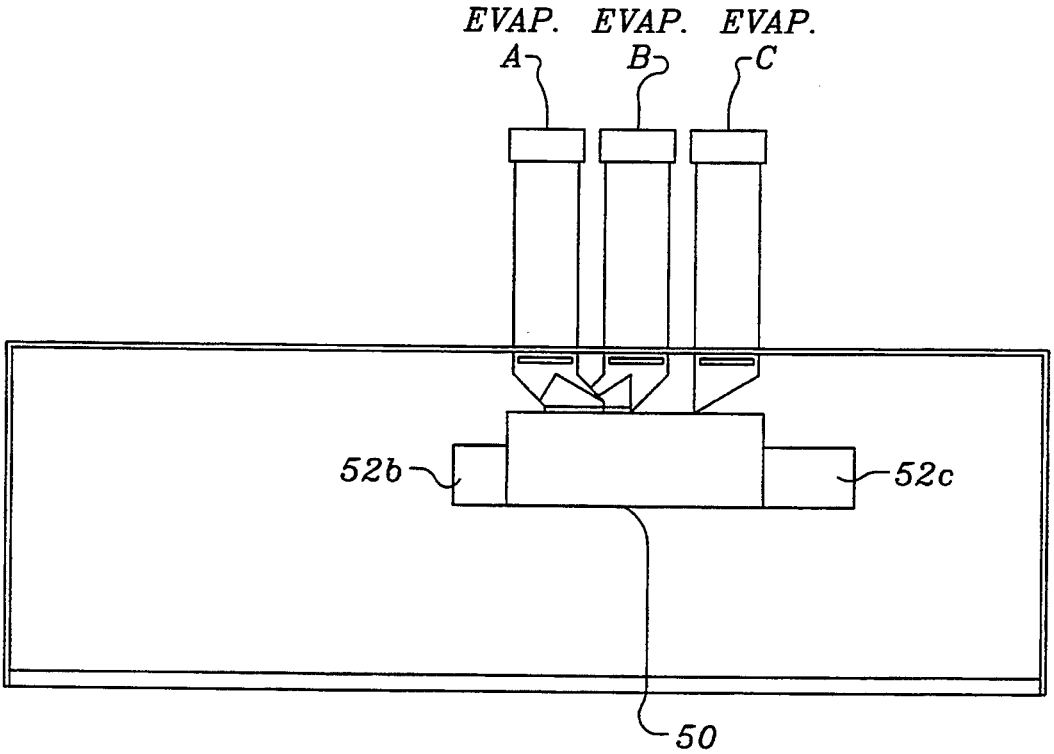
FIG. 4 is a side view of the structure illustrated in FIGS. 2 and 3.

The evaporators A, B, C, carousel ice hold-up tank 50, separation tanks 52*a*, 52*b*, 52*c* and sluice lines 60*a*, 60*b*, 60*c* are shown pictorially in FIG. 2, in top view in FIG. 3 and in side view in FIG. 4. Ice discharged from the ice machine and water that passes unfrozen through the ice machine are dumped directly from evaporators A, B, C into hold-up tank 50 which is maintained full of water. (As explained in more detail below in connection with a discussion of the flow rates, etc., the ice always travels in a two-phase, ice-in-water situation.) The ice and water input to hold-up tank 50 preferably is accomplished by a tangentially directed flow which imparts a circular, carousel motion at the water surface so that ice in the tank (floating, of course) is always circling the tank in a rotational movement about the central vertical axis of the tank. It will be appreciated that this circular motion would naturally move the ice particles to the middle of the tank as centrifugal force displaces the lighter ice with water at the wall of the tank. However, means are provided for overcoming these centrifugal forces in the tank to assure that the ice particles are pushed to the circular boundary wall at the periphery of the tank where the ice flows out of the weirs, as described in more detail below. To this end, in the illustrated embodiment, sluice water makeup line 88 is brought to the middle of the hold-up tank 50 where its flow impinges on a diverter plate 68 that is approximately two inches below water level W/L to create a radially outward flow condition at the surface of the water to force the ice particles out to the periphery of the tank.

Hold-up tank 50 includes three weirs 70*a*, 70*b*, 70*c* at the water level in the tank that permit ice/water to overflow at a controllable, evened out rate into the respective separation tanks 52*a*, 52*b*, 52*c*. In turn, tanks 52*a*, 52*b*, 52*c* each have weirs 80*a*, 80*b*, 80*c* that permit the ice entrained in a selected portion of the water in these separation tanks to overflow into the sluice lines 60*a*, 60*b*, 60*c*, while the remainder of the water in the separation tanks is removed at the bottom of the tanks for return to the respective evaporators A, B, C of the ice machine. Thus, roughly stated, the system shown and described above serves to even out the spiked, uneven ice dumping rate from evaporators A, B, C into a more even flow condition that will not overwhelm the remainder of the ice transport system carrying the ice particles into the thermal energy storage tank.

Separation tanks 52*a*, 52*b*, 52*c* are substantially smaller than hold-up tank 50, for example, four feet in diameter. The ice particles are separated from the water and the water is returned to the ice machine by pulling out this return water at the bottom of the tanks to conduits 85*a*, 85*b*, 85*c* while permitting the ice to overflow through the tanks respective weirs 80*a*, 80*b*, 80*c* with the remainder of the water. This remaining water not only carries the ice particles through the weirs, but also serves as the transport water for conveying the ice to thermal energy storage tank 12 via conduits 60*a*, 60*b*, 60*c*. Screens 82*a*, 82*b*, 82*c* are provided in the respective separator tanks to assure that ice is not sucked out into conduits 85*a*, 85*b*, 85*c*. In this regard, the diameter of the separation tanks is chosen to be large enough so that the drag force caused by suction at the bottom of the tanks is not so great as to overcome the buoyancy of the ice particles. In other words, the cross-sectional area of the separation tanks must be large enough so that the ice particles can continue to float in the tanks.

The flow regime will now be described with primary reference to the schematic of FIG. 1. Each evaporator A, B, C receives a substantially constant water input at 500 GPM from separation tanks 52*a*, 52*b*, 52*c* via lines 85*a*, 85*b*, 85*c*, respectively. Of the 500 GPM input water to each evaporator A, B, C, approximately 10 GPM is frozen to ice in each evaporator, with the remainder simply flowing through the evaporator and back to hold-up tank 50 where it creates the rotational, carousel surface water motion. The ice accumulates in each evaporator A, B, C over the fifteen minute cycle and is dumped at the time intervals shown in FIG. 5. In addition to the water from evaporators A, B, C, water is also being continuously introduced into hold-up tank 50 at a rate of 480 GPM from thermal energy storage tank 12 via line 88. This water returned to hold-up tank 50 by line 88 has three functions: (i) to provide make-up water for that which has been turned to ice, (ii) to provide sluice water to permit transport of ice to the thermal energy storage tank, and (iii) to provide the above-mentioned radial outward flow at the top of the tank to combat centrifugal force and move the ice particles out to the walls of the tank where they can overflow through the weirs.

Looking further at the flow regime, it will be appreciated that the separation tanks 52*a*, 52*b*, 52*c* may serve to enhance the "hold-up" and related flow rate leveling out function according to the structure chosen for these tanks. Generally stated, if the separation tanks are designed to achieve a significant ice residence time therein, these tanks will further level out the flow. On the other hand, the separation tanks can be designed to simply pass the ice directly through with minimum residence time, in which case they do little to enhance the leveling out of the ice flow rate. The residence time is largely controlled by matching the weir size in the separation tanks to the size of the pipes delivering the ice/water from the hold-up tank.

Figure 6:
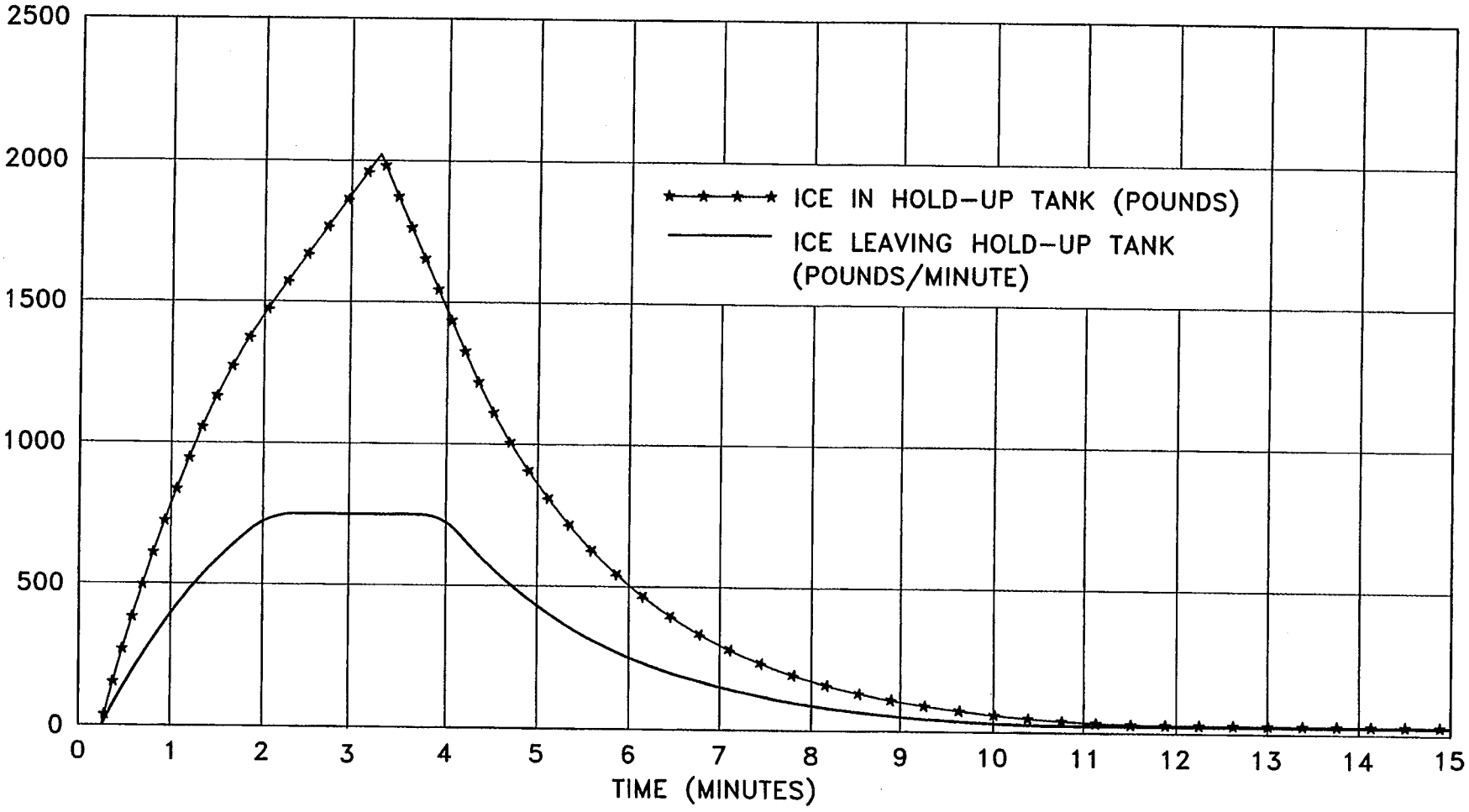
FIG. 6 is a graph showing (i) the amount of ice in the hold-up tank over a fifteen minute ice production cycle and (ii) the rate at which ice leaves the hold-up tank for delivery to the ice/water separation tanks.

The starpoint curve in the graph of FIG. 6 shows the amount of ice in the hold-up tank over a fifteen minute ice production cycle while the solid curve shows the rate at which ice is discharged from the tank to the three separation tanks. It will be appreciated that ice builds up in the tanks over the first three minutes of the cycle when all of the ice is dumped and thereafter the ice level in the hold-up tank diminishes as it overflows through weirs 70*a*, 70*b*, 70*c* at a controlled rate. In the situation illustrated in FIG. 6, the ice is effectively fully discharged from hold-up tank 50 by minute ten of the fifteen minute cycle. However, the discharge rate may be controlled to a faster or slower rate. In this regard, one means for controlling the ice discharge rate from hold-up tank 50 is to slow down or speed up the rate of rotary motion of the ice particles in the hold-up tank. This can be accomplished, for example, by adjustment of the discharge conditions of the three lines from evaporators A, B, C that create the rotary motion. In operation of the illustrated embodiment to achieve the flow conditions shown in FIG. 6, the ice rotation in hold-up tank 50 is maintained at a rate on the order of one revolution per minute. The discharge rate also can be controlled by adjusting the radial outward force applied to the ice particles to overcome their tendency to move to the center of the hold-up tank under the influence of centrifugal force. In the illustrated embodiment which incorporates diverter plate 68, this adjustment can be made by controlling the amount of flow from line 88 that is devoted to this purpose, or the manner in which this flow creates the radial outward force for moving the ice particles to the tank walls. Thus, by utilizing these or other operational adjustments, the discharge rate of the ice particles from the hold-up tank, and the resultant rate at which ice is delivered to the thermal energy storage tank can be controlled.

Figure 7:
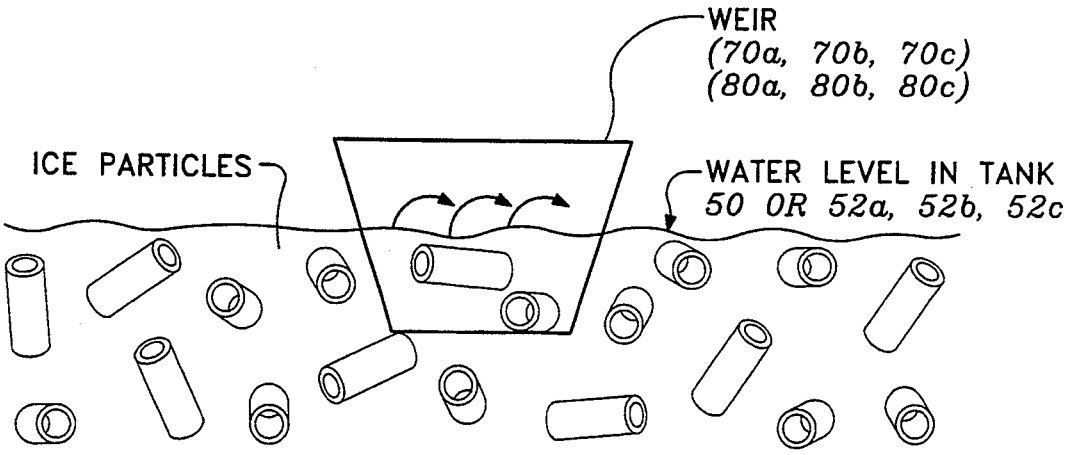
FIG. 7 is a view of one representative weir of the type incorporated into both the hold-up tank and each of the ice/water separation tanks.

The term "weir" is used herein in a broad sense to include any opening configuration that will pass the two-phase ice/water mixture in a desirable manner from the tank(s). For use in association with system 10 illustrated in FIG. 1–4, the weirs 70*a*, 70*b*, 70*c* take the form shown in FIG. 7. It is desirable that the base width of the weir be on the order of twice the length of the solid particles that are passing therethrough in the two-phase flow. In the case of the ice mac, no mentioned above, typical ice particle lengths are approximately three inches, thus the base width of weirs 70*a*, 70*b*, 70*c* is chosen as six inches. The weir sidewalls diverge outwardly from the base at an angle on the order of 10□–15□ to a height on the order of ten inches with the width at the top of the weir being approximately ten inches.

In certain applications of the invention, particularly "retrofit" applications, the hold-up tank may have a square or other rectangular shape as viewed from above. In the case of a square tank, a standpipe may be located in each of the four corners of the tank with each standpipe including a weir similar to the one shown FIG. 7. Thus, the square hold-up tank is provided with weirs located at the periphery of the tanks so that ice particles and a portion of the water in the tank may overflow through the weirs and be conveyed by the standpipes for further transport in accordance with the principles of the invention.

In operation of the present invention in situations where there is more than one destination for the particulate material, for example, the three hoppers/downpipes associated with thermal energy storage tank 12, there may be situations where it is desirable or necessary to reduce or eliminate particulate flow to one destination, while continuing particulate flow to the remaining destinations. In the case of the illustrated thermal energy production, storage and reclaim system 10, there may be occasions when no further ice is needed at one downpipe location while the other locations still need ice (due to an uneven ice melt). Or, alternatively, the thermal energy storage tank may have no further room for ice at one of the downpipe locations. To address these situations, an ice dam system 100 (FIG. 8) has been developed to block the passage of ice particles through its respective weir 70*a*, 70*b* or 70*c* of the hold-up tank, while permitting water to pass through the weir. It will be appreciated that full production of ice by evaporators A, B, C will continue, and that the remaining weirs and transport lines must accommodate the extra ice flowing through them with the same flow rate of transport water.

Figure 8:
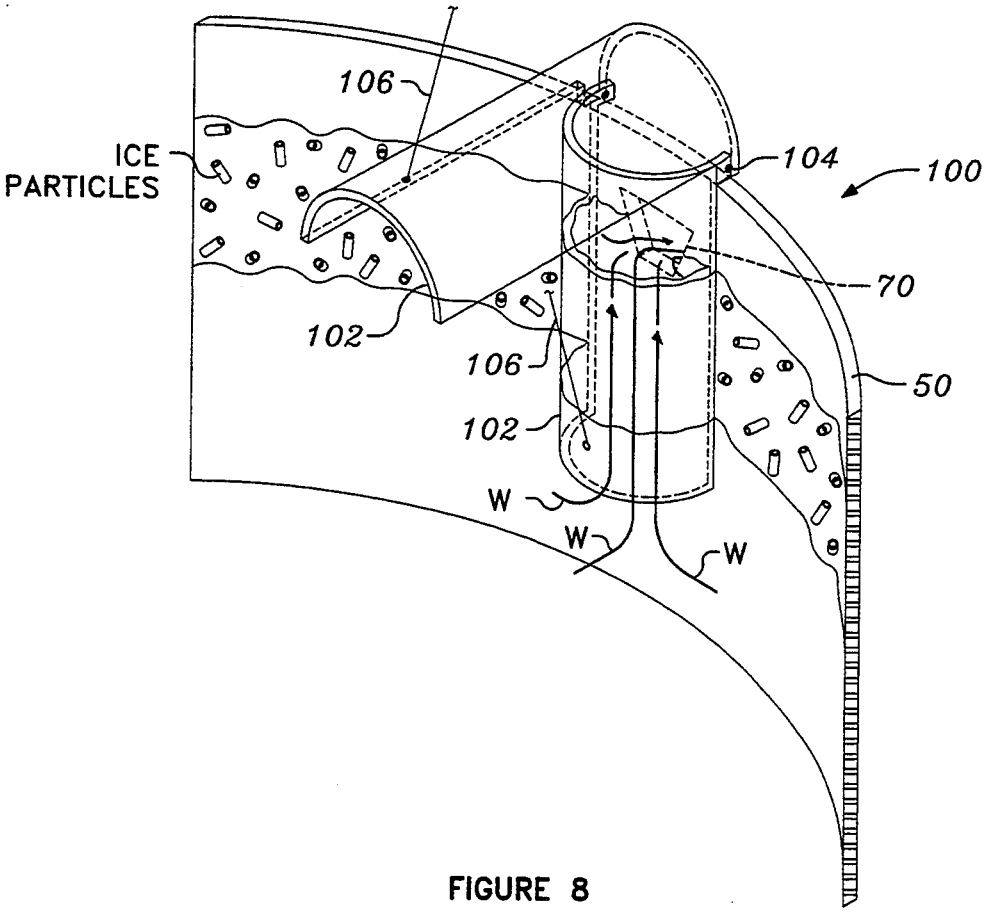
FIG. 8 is a view of an ice dam structure used to eliminate ice particle flow through one of the weirs of the hold-up tank when no ice is needed at the destination coupled to that weir, while permitting water to flow through the weir.

In the embodiment illustrated in FIG. 8, ice dam system 100 includes a half-round pipe section 102 that is mounted at its upper end to the top of hold-up tank 50 for raising and lowering about a hinge 104. Hinge 104 is located directly above one of the weirs 70. In normal operation of the ice conveyance system, pipe section 102 is maintained in its raised position by means of a cable 106. With pipe section 102 in this raised position, the ice dam system permits the usual two-phase ice/water mixture to flow through the weir. However, in those situations when it is desired that no ice be delivered to the destination associated with the weir, the pipe section is lowered to its vertically-oriented position over the weir by release of cable 106. In the vertical position, the ice dam system serves to block the floating ice particles from entering the weir while permitting water to flow along the path depicted by the arrows W in FIG. 8. Thus, in the embodiment illustrated in FIGS. 1–4, ice delivery to any one of the hopper/downpipe locations at the thermal energy storage tank may be blocked while permitting water only to flow to that location. It will be appreciated that the half-round cross section of the pipe section presents a relatively smooth transition surface to the rotating ice particles in the hold-up tank and, therefore, does not jam or block the rotating ice particles.

When ice dam system 100 is used in connection with the embodiment of FIG. 1–4, the ice dam system is designed for automatic deployment when the ice delivery hopper associated with the system becomes blocked because of an "ice full" situation at the bottom of the downpipe (or in the unlikely event of an unexpected ice jam in the hopper). To this end, each hopper is provided with a sensor to sense ice blockage in the hopper and to convey that information to a mechanism that releases cable 106, thereby permitting pipe section 102 to be lowered about hinge 104 to its lowered position over the weir. In a particular embodiment, the sensor at the hopper may take the form of a conventional bin level indicator (not shown), for example, a Model No. KA bin level indicator produced by Monitor Manufacturing Company of Elburn, Ill. The bin level indicator may be conveniently coupled to a solenoid that actuates a jam cleat (not shown) holding cable 106.

In use of the ice dam system in connection with a hold-up tank delivering to three destinations, as is the case with system 10 illustrated in FIGS. 1–4, it has been found desirable to provide an automatic trip mechanism in the event that two of the three delivery points to the thermal energy storage tank become blocked simultaneously so as to prevent a situation where two ice dam systems 100 are blocking two of the three weirs 70 in the hold-up tank thereby requiring a single weir to handle the entire ice flow.

In one preferred embodiment, for use with the mentioned weir configuration having a base width of approximately six inches, a top width of approximately ten inches and a height of approximately ten inches, the pivotally mounted pipe section 102 is formed as a half-round section of twelve inch diameter schedule 80 PVC pipe. The pipe section has a length sufficient to assure that its lower end extends approximately eighteen inches below the water level in hold-up tank 50 when it is lowered to its vertical position, while the upper portion extends approximately twelve inches above the water line to hringe 104. Thus, a pipe section having a length on the order of thirty inches suffices.

Figure 9:
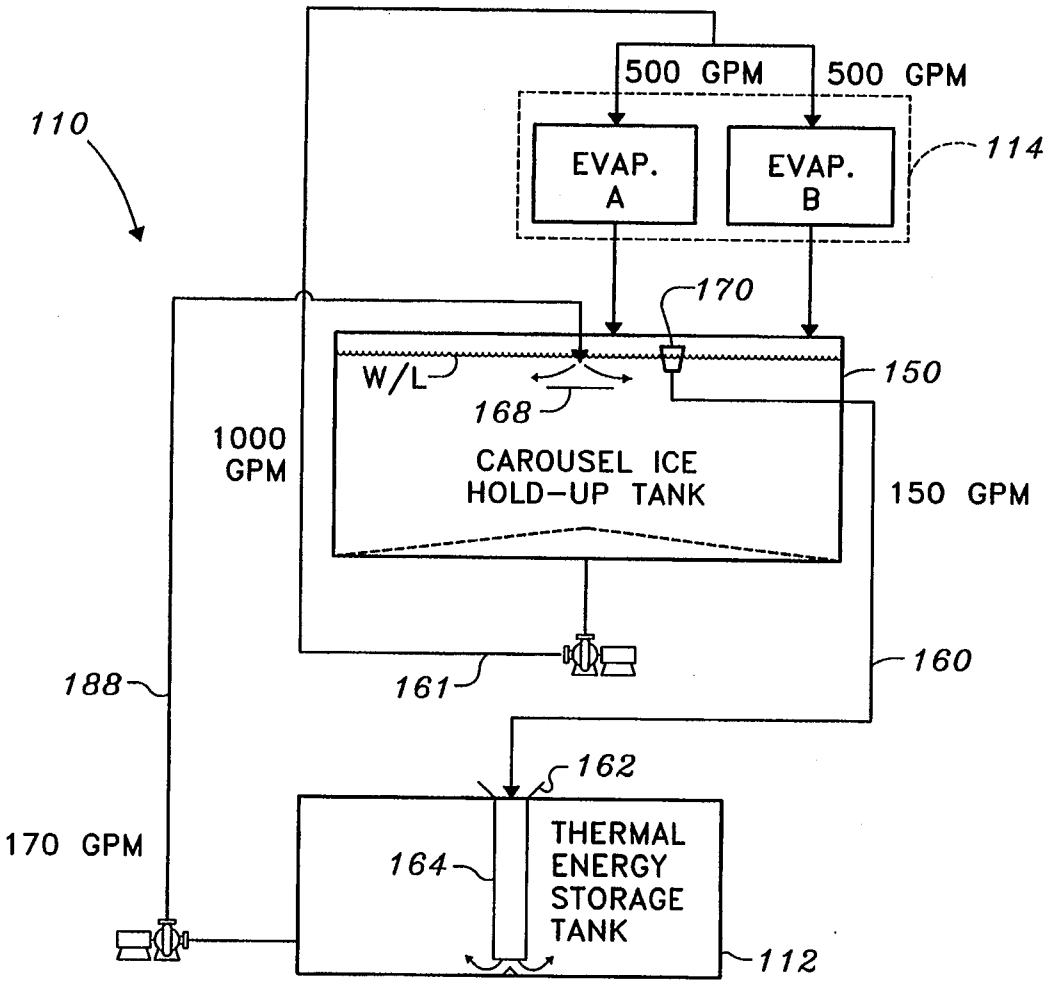
FIG. 9 is a schematic representation similar to FIG. 1, but showing another ice harvesting thermal energy production, storage and reclaim system having a single ice delivery point in the thermal energy storage tank.

An alternative application of the present invention will now be described with reference to the schematic diagram of FIG. 9. Ice harvesting thermal energy production, storage and reclaim system 110 of FIG. 9 is a system similar to that of system 10 illustrated in FIG. 1 except that the thermal energy storage tank 112 includes only one ice introduction system (hopper 162, downpipe 164). System 110 includes a 120 ton per day ice machine 114 having two evaporators A and B for batch delivery of ice in two one minute "slugs" in a fifteen minute ice production cycle. In some situations, this ice machine may be the machine specified in the original design of system 110. However, the present invention also has an important utility in those cases where an ice harvesting thermal energy production, storage and reclaim system is retrofitted with a substantially larger batch delivery ice machine than the original system design, resulting in a situation where the ice delivery system (conduit/hopper/downpipe) that was sufficient to handle the batch discharged from the original ice machine, for example, a thirty ton per day machine, cannot handle the batch delivery from the retrofit machine, for example, the mentioned 120 ton per day machine.

System 110 includes a carousel ice hold-up tank 150 that receives the batch ice delivery from ice machine 114. Hold-up tank 50 includes a single weir 170 that communicates directly with storage tank 112 through line 160. System 110 also includes a return line 161 that draws water from the bottom of hold-up tank 50 for return to the evaporators A and B of the ice machine. The flow regime is as follows: Each evaporator A, B receives a substantially constant water input at 500 GPM from hold-up tank 150 via line 161. Of the 500 GPM input water to each evaporator A, B, approximately 10 GPM is frozen to ice in each evaporator, with the remainder flowing through the evaporator and back to hold-up tank 150 where it creates the rotational, carousel surface water motion. In addition to the water from evaporator A, B, water also is being continuously introduced into hold-up tank 150 at a rate of 170 GPM from thermal energy storage tank 112 via line 188 with this flow being brought to the middle of tank 150 where it impinges on diverter plate 168 to create a radially outward flow condition at the surface of the water to force the ice particles out to the periphery of the tank.

Thus, in the particular situation illustrated in FIG. 9, the ice particle flow rate leveling function is carried out without an ice/water separation tank located between weir 170 of the hold-up tank and the hopper/downpipe/storage tank. The reason is that the low flow rate of 150 GPM through weir 170, while so low as to encourage occasional blocking or jamming of ice particles at the weir, is acceptable in this situation because, as the ice builds up at the weir during a blockage situation, it will ultimately break free because of the shape of the weir. On the other hand, in the multiple weir/multiple destination situation of FIGS. 1–4, a blockage situation at one of the weirs 70*a* or 70*b* or 70*c* would not necessarily become unblocked because the ice/water would simply flow at greater rates through the other two weirs while the blockage remained. Thus, in the embodiment of FIGS. 1–4, it is desirable to have a considerably larger flow through each weir 70*a*, 70*b*, 70*c* (650 GPM vs. 150 GPM) to eliminate the possibility of a blockage occurring. At these higher flow rates, it becomes desirable to separate out most of the water from the ice (in the ice/water separation tanks 52*a*, 52*b*, 52*c*) so that most of the water (500 GPM at each tank 52*a*, 52*b*, 52*c*) can be returned directly to the ice machine with a two-phase ice/water mixture of only 150 GPM flowing to the thermal energy storage tank 12.

Figure 10:
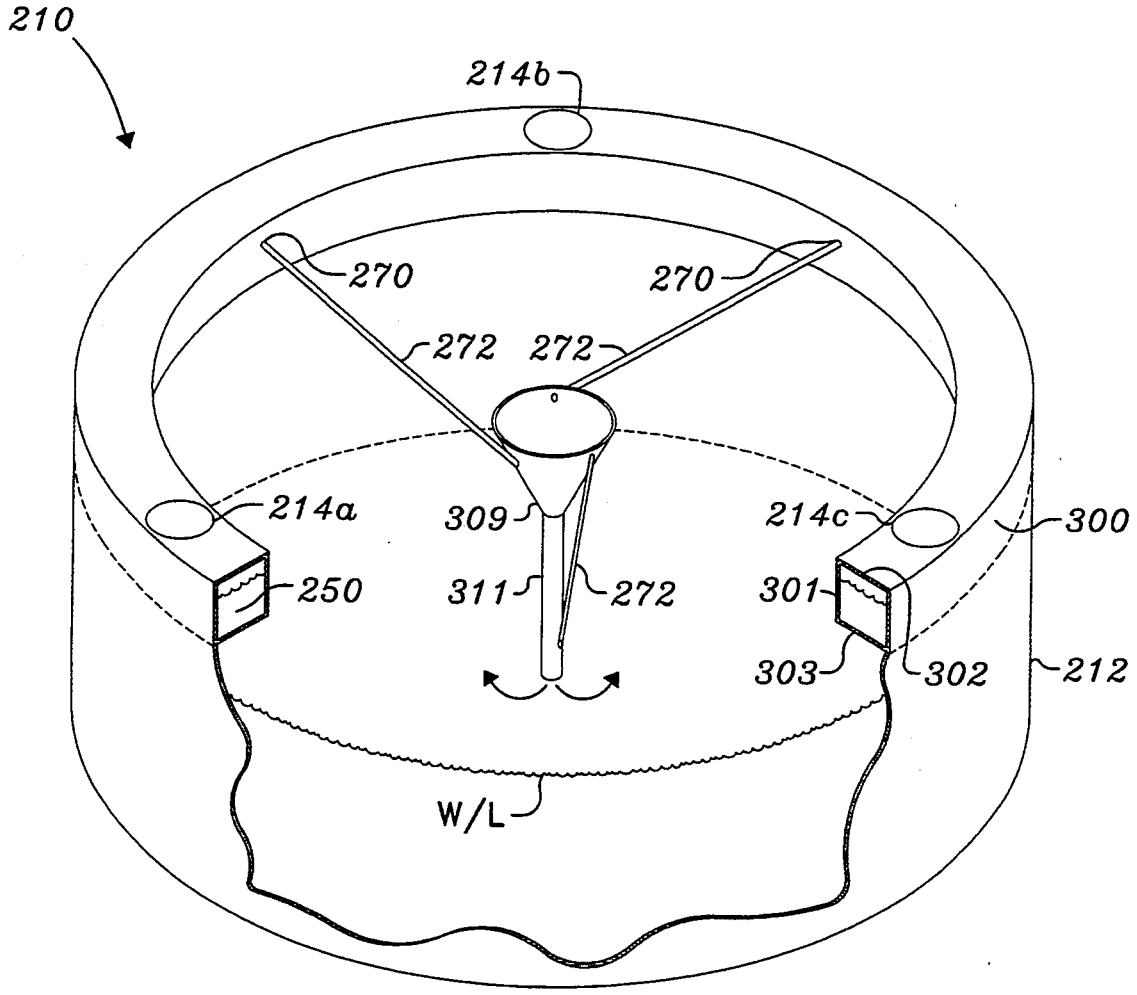
FIG. 10 is a view of another ice harvesting thermal energy production, storage and reclaim system wherein multiple ice machines are located on top of the thermal energy storage tank and ice is delivered to the tank utilizing principles of the present invention.

FIG. 10 is a view of another type of thermal energy production, storage and reclaim system 210 in which ice is conveyed in accordance with the principles of the present invention. System 210 incorporates three ice machines at locations 214*a–c*, a flooded, aboveground thermal energy storage tank 212 with water level W/L and a conduit system for delivering ice to the bottom of tank 212. The ice machines 214*a–c* are batch discharge machines that are mounted on top of the storage tank. The ice machines dump their ice into a hold-up tank that is defined by an outer circular containment war 300, an inner, vertical, circular boundary wall 301, a top war 302 and a bottom wall 303. In the illustrated embodiment, circular wars 300 and 301 are concentric about a common central axis. The annular zone or race defined between outer containment wall 300 and inner wall 301 serves as the hold-up tank 250 for receiving the ice/water discharged from the ice machines. The ice/water in hold-up tank 250 circulates in a rotary motion that is achieved by the same means discussed above in connection with the embodiments of FIGS. 1–4 and FIG. 9, i.e., the tangential discharge from the ice machines into the hold-up tank. This rotary motion assures the creation of a centrifugal force that urges the ice particles toward the inner wall 301. The ice and water circulating in hold-up tank 250 flow through three weirs 270 (not shown in detail) found at the water level in the inner war 301 and thereafter into pipes 272 that communicate with the weirs. Pipes 272 deliver the ice/water from the hold-up tank to a funnel-like member 309 followed by a lower downpipe portion 311 which communicates with the bottom of storage tank 212 for delivery of the ice in the manner preferred in the art, i.e., delivery to the bottom of the storage tank.

The flow regime for system 210 is relatively simple to balance by returning all of the water dumped into hold-up tank 250 to the ice machines along with a sufficient amount of make-up water from the storage tank 212 to make up for the water being frozen to ice.

The embodiment of FIG. 10 utilizes principles of the present invention to overcome problems inherent in the operation of similar systems where the ice from the top-mounted ice machines is simply dumped directly into a dry (i.e., not flooded with water) storage tank.

One additional advantage of the present invention, when utilized in connection with ice transport, is that it permits holding up the ice and leveling out its flow rate without running the risk of having the ice particles agglomerate into an unmanageable ice mass. In this regard, it will be appreciated that the ice particles emerging from the ice machine may be at a temperature on the order of 25□ F. If ice particles at this temperature are dumped dry into a vessel, or if the ice particles are mixed with water and then the water is removed, significant agglomeration will occur, resulting in an ice mass that cannot be conveniently and uniformly melted. Recognizing these potential difficulties, the present invention provides a hold-up situation where the ice particles are maintained in continuous motion in cold water while the temperature of the ice particles is equilibrated to 32□ F. Once at 32□ F., the ice particles are less subject to agglomerating (are less "sticky") and are easier to move.

While the present invention has been described in connection with certain illustrated embodiments, it will be appreciated that modifications may be made without departing from the true spirit and scope of the invention. For example, while the batch delivery of ice particles in slugs from an ice machine is one example of a spiked, uneven flow condition of particulate material that needs to be leveled out to a more even flow condition, other spiked, uneven flows may be modulated utilizing the principles of the present invention.

That which is claimed is:

1. In the operation of a thermal energy production, storage and reclaim system of the type having (i) an ice machine that discharges ice particles in batches, (ii) a thermal energy storage tank that stores the ice and (iii) ice conveyance means for delivering the ice particles from the ice machine to the thermal energy storage tank, a method for leveling out the batch discharge rate of the ice particles to a more even flow condition that facilitates the conveyance of the ice particles to the thermal energy storage tank, said method comprising:

directing ice particles discharged by an ice machine in batches to a hold-up tank containing water;

imparting a rotational surface movement to the water in the hold-up tank sufficient to carry the ice floating in the tank in a rotary motion;

providing a radially outwardly directed surface flow in the water in the hold-up tank to overcome centrifugal forces and urge the rotating ice particles to the periphery of the hold-up tank;

overflowing the ice particles and a portion of the water in the hold-up tank through at least one weir located at the periphery of the tank at the water surface level at an ice particle flow rate that is leveled out to a more even rate than the rate at which ice is discharged to the hold-up tank;

conveying the ice from the at least one weir to the thermal energy storage tank at a leveled out, more even rate than the rate at which ice is discharged to the hold-up tank; and maintaining the water and ice flow rates among the ice machine, hold-up tank and thermal energy storage tank at levels that serve to balance the flow regime for the entire thermal energy production, storage and reclaim system.

2. The method of claim 1 including the step of controlling the ice delivery rate through the at least one weir by selection of (i) weir configuration and (ii) the rate of rotary surface movement imparted to the water in the hold-up tank.

3. The method of claim 1 wherein the step of imparting a rotational surface movement to the water in the hold-up tank is achieved by discharging ice and water from the ice machine tangentially onto the surface of the water in the hold-up tank.

4. The method of claim 1 wherein said hold-up tank includes only one weir and including the step of returning a majority portion of the water from the hold-up tank directly back to the ice machine while permitting another minority portion of the water to overflow through the weir to facilitate carrying the ice through the weir and to serve as the transport water for delivering the ice to the thermal energy storage tank.

5. The method of claim 1 including the step of conveying the ice to multiple destination points at the thermal energy storage tank and further including the step of overflowing the ice particles from the hold-up tank through multiple weirs, the number of which corresponds to the number of destination points for the ice.

6. The method of claim 5 including the step of overflowing the ice particles and water from each weir into a respective ice/water separation tank and returning a majority portion of the water from the separation tank directly back to the ice machine while permitting the remainder of the water flow through the separation tank to serve as the transport water for carrying the ice particles to one of the destinations at the thermal energy storage tank.

7. The method of claim 6 including the step of further leveling out the flow rate of the ice particles by controlling the residence time of the ice particles in the ice/water separation tanks.

8. The method of claim 5 including the step of blocking ice overflow to one of the weirs while permitting water to flow through the weir at times when no ice delivery is required at the destination point associated with the weir.

9. The method of claim 8 including the step of blocking ice overflow to the weir by lowering an ice dam over the weir and permitting water to flow under the dam and upwardly to the weir while blocking the floating ice particles from entering the weir.

10. In the operation of a thermal energy production, storage and reclaim system of the type having at least one ice machine providing ice to a flooded thermal energy storage tank that stores ice produced by the machine for later use of the stored thermal energy to satisfy a load that is uncoupled from the power supply, a method for delivering the ice particles discharged from the ice machine to the bottom of the flooded storage tank, said method comprising:

operating at least one ice machine to produce ice particles;

directing the ice particles produced by the ice machine to a ring-like hold-up tank having an outer containment wall and an inner, circular boundary wall with the hold-up tank containing water and being located above the water line of a flooded thermal energy storage tank;

imparting a rotational surface movement to the water in the hold-up tank sufficient to carry the ice floating in the tank in a rotary motion about the central axis of the tank and in proximity to the inner, circular boundary wall; and overflowing the ice and a portion of the water in the hold-up tank through at least one weir located in the inner, circular boundary wall and delivering the overflowing ice/water mixture to the bottom of a flooded thermal energy storage tank.

11. The method of claim 10 including the step of overflowing the ice and a portion of the water in the hold-up tank through multiple weirs located in the inner, circular boundary wall and directing the ice/water mixture overflowing through the multiple weirs to a delivery system for injecting of the ice/water mixture below the water level in a thermal energy storage tank.

12. In a thermal energy production, storage and reclaim system of the type having an ice machine that produces ice particles in batches, a thermal energy storage tank that stores the ice and ice conveyance means for delivering the ice particles from the ice machine to the thermal energy storage tank, an apparatus for leveling out the batch discharge rate of the ice particles to a more even flow condition that facilitates the conveyance of the ice particles to the thermal energy storage tank, said apparatus comprising:

a hold-up tank defining a substantially circular boundary wall, said hold-up tank containing water;

means for directing ice particles discharged by an ice machine in batches to said hold-up tank;

means for imparting a rotational surface movement to the water in the hold-up tank sufficient to carry the ice floating therein in rotary motion;

means for assuring that the rotating ice particles move around the hold-up tank in proximity to said circular boundary wall;

at least one weir located in said circular boundary wall at the water level of the hold-up tank; and a delivery system for delivering an ice/water mixture overflowing through said at least one weir to a thermal energy storage tank.

13. The apparatus of claim 12 wherein said hold-up tank takes the form of a ring-like tank having an outer containment wall and an inner circular wall that includes said at least one weir and serves as said circular boundary wall.

14. The apparatus of claim 12 wherein said hold-up tank takes the form of an upright cylindrical tank and said circular boundary wall is the outer circular wall of the cylindrical tank.

15. The apparatus of claim 14 including multiple weirs in the outer circular wall of the hold-up tank and said delivery system including means providing fluid communication between each weir and an ice delivery point in the thermal energy storage tank.

16. The apparatus of claim 14 including multiple weirs in the outer circular wall of the hold-up tank, an ice/water separation tank associated with each hold-up tank weir for receiving the ice/water overflowing therethrough, each separation tank including means for returning a portion of the water entering the separation tank directly back to the ice machine and a weir at the water level in the separation tank for overflowing the remainder of the water and the ice for transport to the thermal energy storage tank via said delivery system.

17. The apparatus of claim 16 including a sluice water return line for returning water from the thermal energy storage tank back to the ice machine.

18. The apparatus of claim 17 including (i) means for supplying make-up water and (ii) properly sized pumps in the lines connecting the separation tanks and the thermal energy storage tank for balancing the flow regime.

19. The apparatus of claim 12 including multiple weirs in the circular boundary wall of said hold-up tank, and including an ice dam associated with at least one of the weirs for reducing or eliminating ice flow through that weir at times when reduced or no ice is needed at the destination in the thermal energy storage tank associated with that weir.

20. The apparatus of claim 19 wherein said ice dam includes a half-round pipe section that is moved into position over the weir with portions of the pipe section extending both above and below the hold-up tank water line so that the pipe section blocks ice flow to the weir while permitting water to flow therethrough.

21. In the operation of an ice production and storage system including a batch discharge dynamic harvesting ice machine, a flooded storage vessel for storage of ice particles produced by the machine, a transport system for transporting the ice particles entrained in water from the ice machine to the storage vessel and an ice particle injection system in the storage vessel for injecting the buoyant ice particles to a submerged location in the vessel, a hydraulic conveyance method for leveling out the batch flow condition of the ice particles as they exit the ice machine to a more even flow condition devoid of spikes that would otherwise overwhelm the ice particle injection system, said method comprising the step, performed in the transport system, of introducing the ice particles entrained in water into a hold-up tank at a spiked ice particle flow rate on the order of the batch ice discharge rate produced by the ice machine and withdrawing the ice particles entrained in water from the hold-up tank at a more even flow condition that will not overwhelm the injection system.

* * * * *